United States Patent [19]

Ambasz

[11] Patent Number: 4,679,954

[45] **Date of Patent: * Jul. 14, 1987**

[54] FLEXIBLE PEN WITH SLIDING SLEEVE

[76] Inventor: Emilio Ambasz, 295 Central Park West, New York, N.Y. 10024

[ * ] Notice: The portion of the term of this patent subsequent to Apr. 8, 2003 has been disclaimed.

[21] Appl. No.: 821,541

[22] Filed: Jan. 22, 1986

[51] Int. Cl.[4] ..... B43K 9/00; B43K 7/00

[52] U.S. Cl. ..... 401/117; 401/209; 401/214

[58] Field of Search ..... 401/117, 209, 214

[56] References Cited

U.S. PATENT DOCUMENTS

| | | | |
|---|---|---|---|
| 928,312 | 7/1909 | Lloyd | 401/117 |
| 1,059,398 | 4/1913 | Schreiber | 401/117 X |
| 4,580,919 | 4/1986 | Ambasz | 401/214 X |

*Primary Examiner*—Steven A. Bratlie

*Attorney, Agent, or Firm*—Brumbaugh, Graves, Donohue & Raymond

[57] ABSTRACT

A pen comprises an elongated one-piece barrel having substantially rigid tip end and head end portions joined to each other by an intermediate integral flexible portion, whereby the barrel can be bent at the flexible portion, and a writing tip at the distal end of the tip end portion. A substantially rigid tubular cap member is telescopically received over the tip end portion of the barrel such that it can be moved along the barrel between (1) a retracted position in which it overlies part of the tip end portion and substantially all of the flexible portion, thus exposing the writing tip for use and rendering the pen substantially rigid, and (2) an extended position in which it covers the writing tip and leaves the flexible portion exposed, thus protecting the writing tip and rendering the pen flexible. At least one boss on the inner surface of the cap is received in a slot extending coextensively with the distance between the extended and retracted positions. The slot has a circumferentially offset locking portion at each end for releasably retaining the cap member in each of the retracted and extended positions in the absence of rotation of the cap member.

8 Claims, 7 Drawing Figures

FLEXIBLE PEN WITH SLIDING SLEEVE

BACKGROUND OF THE INVENTION

Ball-point pens come in a variety of types, shapes and sizes and range in cost from as little as a few cents to several hundred dollars. The present invention relates to an inexpensive ball-point pen.

Relatively low cost ball-point pens can be found in both the retractable type, in which the writing tip extends from and retracts into a barrel, for example, by pressing in a push button at the head end of the barrel or by rotating one portion of the barrel relative to another portion, and the fixed type, some of which have removable caps, in which the writing tip is permanently fastened to the barrel. Generally, the retractable types are somewhat more costly to produce and, therefore, more expensive than the fixed types. The retractable types are generally preferable from the point of view of being transportable in a pocket or purse; the detachable caps of ball-point pens tend to get lost. Moreover, the barrel of a pen with a detachable cap can easily become detached from the cap when the pen is carried in a pocket or purse, in which case a shirt can be ruined or items in a pocketbook or coat pocket defaced.

Ball-point pens, and for that matter all writing instruments, are not particularly convenient to carry, but most people like to carry a pen anyway. When clipped to a shirt pocket or coat pocket, a pen can poke or press against the wearer from time to time. Some pockets are not deep enough to fully accept the pen. There is often not enough room in small compartments of purses or in small change purses to receive the conventional ball-point pen.

SUMMARY OF THE INVENTION

There is provided, in accordance with the present invention, a ball-point pen that is, in a sense, of the retractable type, in that the writing tip is exposed in one configuration and covered and protected in another configuration. In another sense, it is not a retractable type, inasmuch as there is no retraction mechanism for moving the writing tip into and out of the barrel, the writing tip being affixed to the barrel. The invention further provides a pen that is flexible when in the configuration in which the writing tip is covered and protected but is rigid when the tip is uncovered for use. The flexibility of the pen in the configuration when the tip is covered and protected allows the pen to bend when placed in a pocket or a purse so that it can fit conveniently into small pockets and purses and so that it can yield and thereby be more comfortable when carried on the person.

In particular the invention is a pen comprising an elongated one-piece barrel having substantially rigid tip end and head end portions joined to each other by an intermediate integral flexible portion, whereby the barrel can be bent at the flexible portion, and a writing tip at the distal end of the tip end portion. A substantially rigid tubular cap member is telescopically received over the tip end portion of the barrel in a manner such that it can be moved along the barrel between (1) a retracted position in which it overlies part of the tip end portion and substantially all of the flexible portion, and thus rendering the pen substantially rigid, and (2) an extended position in which it covers the writing tip and leaves the flexible portion exposed, thus protecting the writing tip and rendering the pen flexible. The cap and barrel have interengaging elements that releasably retain the cap member in each of the retracted and extended positions.

The invention may include the following additional characteristics, separately or in combination:

(1) The cap member has a length such that it covers a major part of the barrel when in the retracted position, the pen being thereby adapted to be held for use by gripping the cap member;

(2) An external circumferential surface of the tip end portion of the barrel closely adjacent the writing tip engages a matching internal surface of the cap member in the retracted position of the cap member, whereby the tip end portion is firmly supported within the cap member when the pen is in use;

(3) The end of the cap member nearer to the head end portion of the barrel telescopically receives a part of the head end portion in the retracted position: and (4) The flexible portion of the barrel comprises at least one bendable strip extending longitudinally between and joined to the tip end and head end portions and a multiplicity of longitudinally spaced-apart ribs extending transversely from the strip at least in each direction of bending of the strip, the adjacent pairs of ribs being engageable upon bending of the strip and limiting the amount of bending of each segment of the strip between adjacent ribs.

The present invention, as described thus far, is described and claimed in U.S. patent application Ser. No. 704,709 of the present inventor filed Feb. 25, 1985 now U.S. Pat. No. 4,580,919, and can best be characterized as a further embodiment thereof that has the advantage of easier manipulation of the cap member. In particular, the tip end portion of the barrel and the internal surface of the cap member have, respectively, at least one coacting groove and a rib received in the groove. The groove is coextensive with the distance between the extended and retracted positions of the cap member and includes locking portions at each end that are offset circumferentially from adjacent portions of the groove and are adapted to lock the cap member in the respective positions in the absence of rotation of the cap member relative to the barrel.

In a preferred embodiment, a major portion of the groove intermediate the locking portions extends substantailly longitudinally of the pen such that the cap member is movable substantially longitudinally of the barrel over a major part of the distance between the extended and retracted positions. Preferably, the end portions of the groove adjacent and locking portions are oriented obliquely to the longitudinal portion so that the direction of rotation of the cap member relative to the barrel into the corresponding locking portion is established before the respective extended and retracted positions are reached in the course of movement from one of the positions to the other.

The main advantages of a pen embodying the present invention are the ability to be bent, which facilitates carrying the pen on the person or in small purses, and the capability of covering the tip when the pen is transported by a cap that is non-detachable and cannot, therefore, get lost. Futhermore, the release of the cap member for movement along the barrel involves a small rotation that requires only a small rotational force. The force resisting undesired lengthwise displacement of the cap member can, meanwhile, be large, thus ensuring maintenance of the retracted and extended configurations during use and transport of the pen.

For a better understanding of the invention, reference may be made to the following description of an exemplary embodiment, taken in conjunction with the figures of the accompanying drawings.

DESCRIPTION OF THE EMBODIMENT

Figure 1:
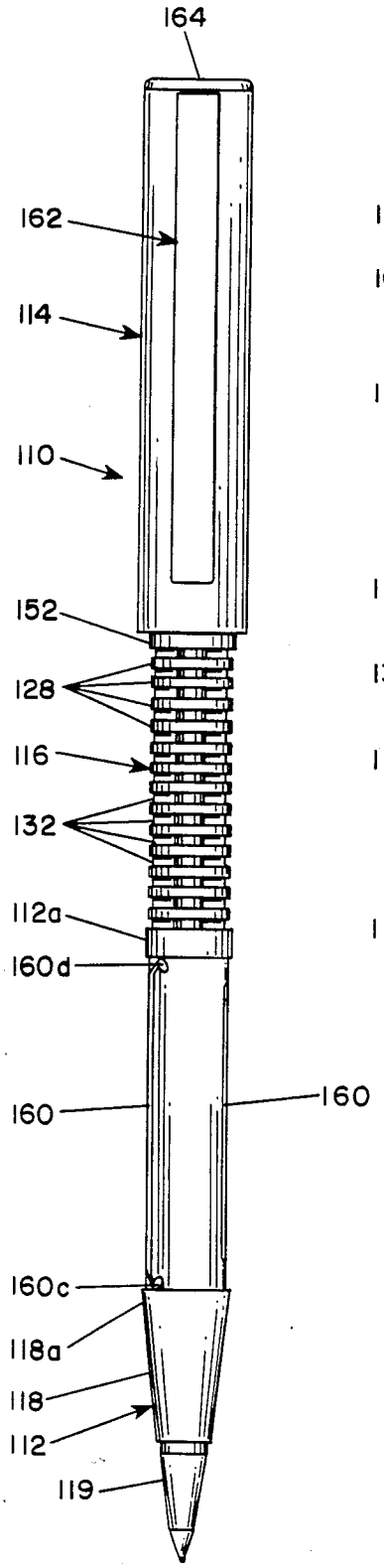
FIG. 1 is a front elevational view of the barrel component.
Figure 2:
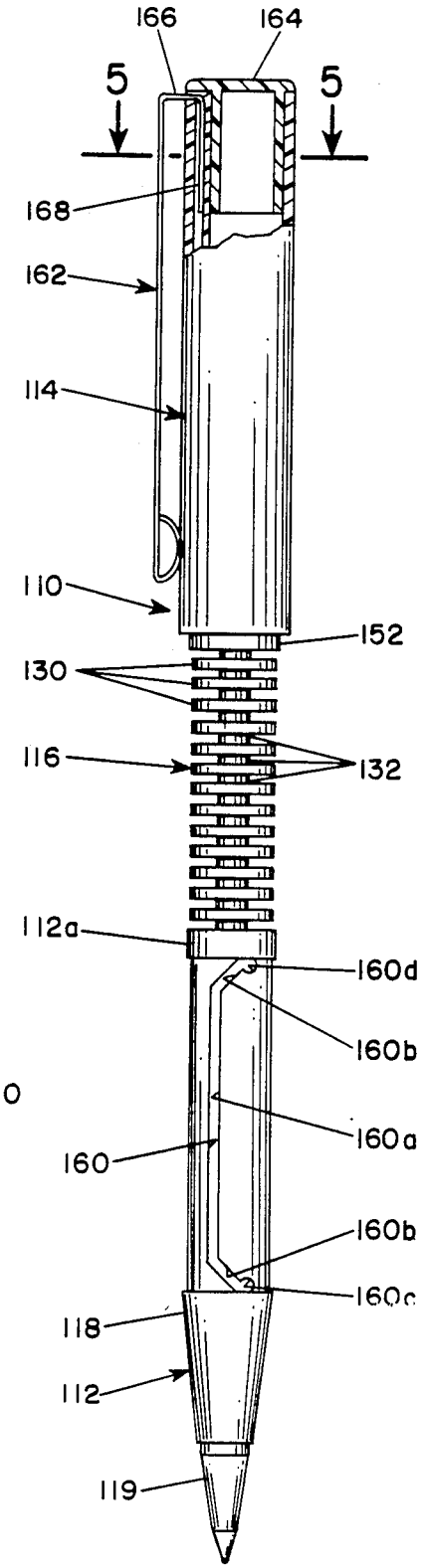
FIG. 2 is a side elevational view of the barrel component, a portion being broken away in cross section.
Figure 4:
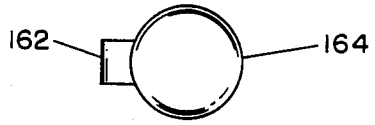
FIG. 4 is a top plan view of the embodiment.
Figure 5:
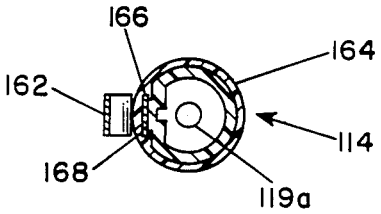
FIG. 5 is a cross-sectional view of the embodiment taken along the lines 5—5 of FIG. 2.
Figure 6:
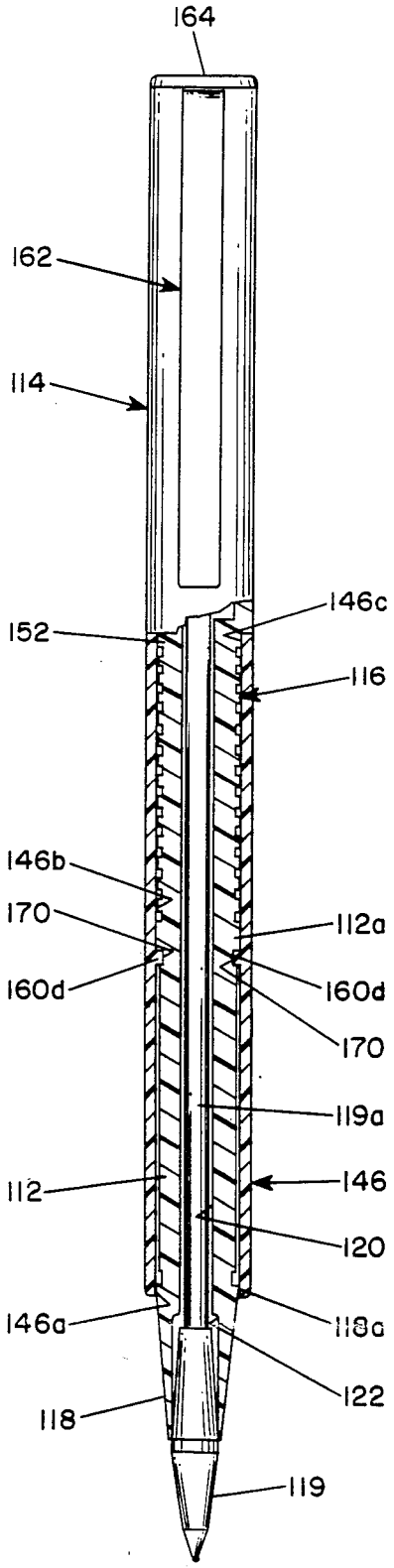
FIG. 6 is a front elevational view of the embodiment as assembled and shows the cap member in the retracted position.

The barrel 110 (FIGS. 1 and 2) is an elongated one-piece member made of a suitable plastic, such as a substantially rigid nylon, by injection molding. It comprises three main sections, a rigid tip end portion 112, a rigid head end portion 114, and an intermediate integral flexible portion 116 joining the tip end and head end portions. The tip end portion 112 is rotationally symmetrical about its longitudinal axis and includes at its distal end a tapered external surface 118 that generally matches the taper of a writing tip 119 of the pen. An internal hole 120 (see FIG. 6) extends coaxially with the axis of the barrel the entire length of the tip end portion 112, the hole having an enlarged portion at the distal end defining a shoulder 122 against which the shank of the writing tip 119 bears. The hole 120 accepts the tubular ink reservoir **119*a*** of a ball-point cartridge, which may be of any suitable construction but preferably has a flexible plastic casing that extends nearly the entire length of the barrel. A short, rigid ink reservoir that does not extend into the flexible portion of the barrel is also suitable.

The tip end portion 112 of the barrel has a pair of narrow, shallow grooves 160, the two grooves being of identical shape and being positioned on diametrically-opposite sides of the barrel. A major portion **160*a* of each groove extends longitudinally (e.g., parallel to the axis) of the barrel. At each end of such longitudinal portion 160*a* is an oblique portion 160*b*, and at the end of each groove 160 is a locking portion 160*c*, 160*d*. The function of the grooves 160** is described below.

The flexible portion 116 of the barrel comprises a multiplicity of circular ribs 128, each of which has a central hole 130 of the same diameter as the hole 120 and, therefore, is able to receive the flexible ink reservoir of the writing tip cartridge. The adjacent ribs are joined to each other, and the endmost ribs are joined to the respective portions 112 and 114, by diametrically-opposite connecting portions 132, the connecting portions being aligned in two rows in the longitudinal direction and being located adjacent the perimeter. The connecting portions 132 define relatively thin lengthwise strips or bands joining the tip end and head end portions. These thin bands can bend back and forth in a direction that is widthwise to the two rows, i.e., in the plane of the paper with respect to FIG. 2 and perpendicular to the plane of the paper with respect to FIG. 1. The annular ribs 128, in addition to serving an aesthetic purpose in that they provide visual mass to what would otherwise be a thin ribbon or ribbons joining two end portions, restrict and control the flexure of the flexible portion by engaging under extreme flexure; each pair of ribs limits the amount of bending that can occur in the connecting portion between them. The annular ribs or rings 128 also join the two strips to each other transversely and stiffen them so they do not bend in the direction of the joinder.

The head end portion 114 of the barrel is tubular for reception of a portion of the ball-point cartridge ink reservoir and has a circular cylindrical external surface. A pocket clip 162 bent out of a thin metal band is retained in the head end portion by a cup-like end member 164 received and suitably secured, such as by a bonding agent, in the end of the head portion 114 and by reception of an L-shaped retaining flange 166 in a slot 168 in the top of the barrel. Instead of the metal pocket clip 162, the pocket clip disclosed in the aforementioned U.S. Pat. No. 4,580,919 can be used in the present embodiment.

Figure 3:
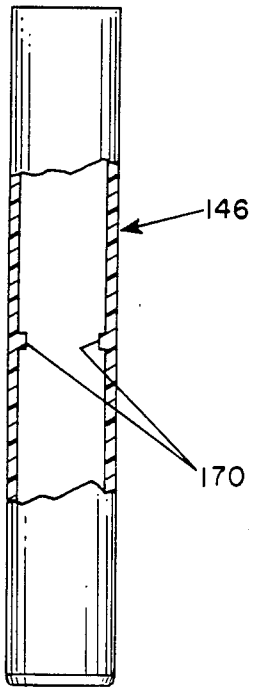
FIG. 3 is an axial cross-sectional view of the cap member, portions being shown in elevation.
Figure 7:
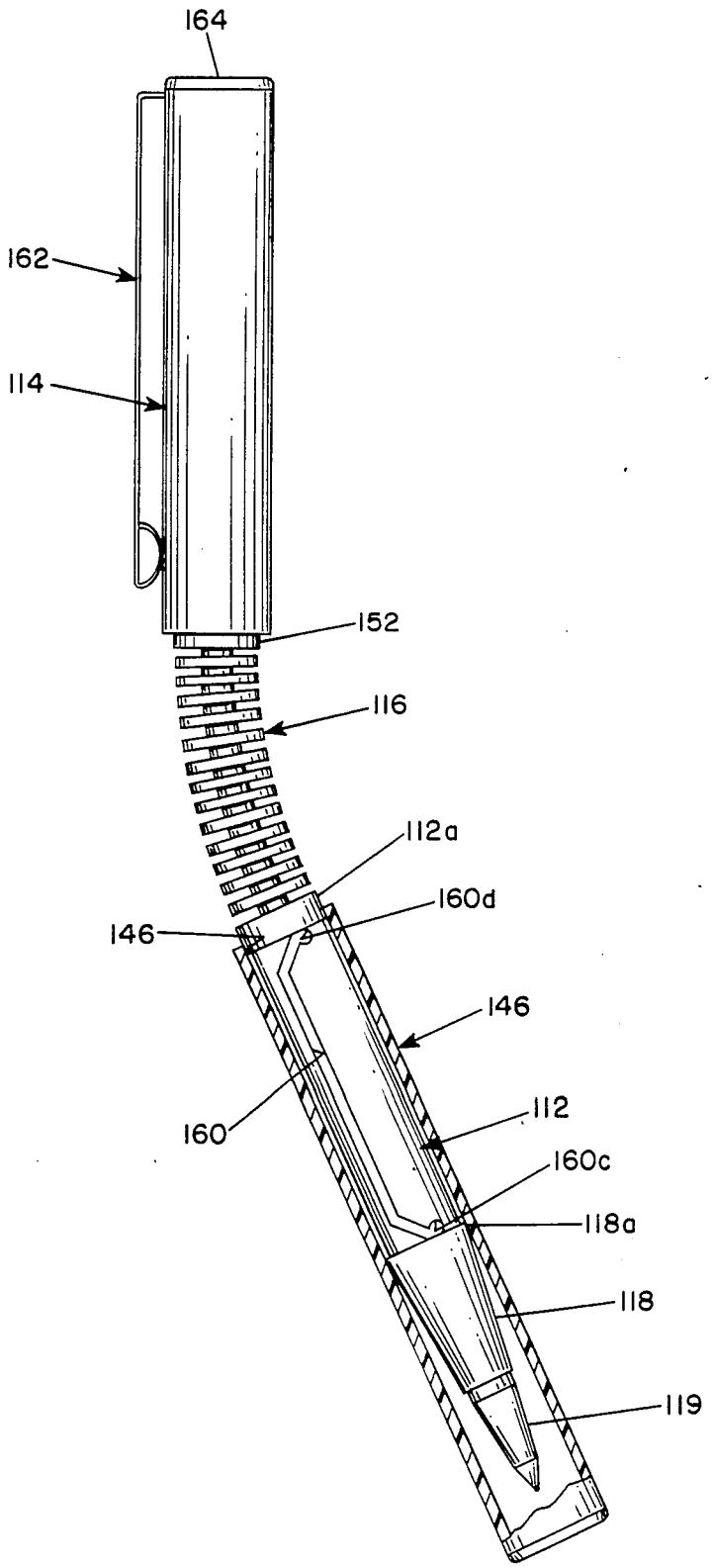
FIG. 7 is a front elevational view of the embodiment as assembled, the cap member being shown in cross section in the extended position, and illustrates how the barrel bends.

The cap member 146 (see FIG. 3) is rotationally symmetrical about a lengthwise central axis. It is tubular and telescopically receives the tip end portion 112 and the flexible portion 116 of the barrel in either of two positions, each of the positions being established and maintained by reception of internal bosses 170 in the respective grooves 160 on the tip end portion of the barrel. When the bosses 170 are positioned in the locking portions **160*c*, the cap 146 is in the extended position and covers and protects the writing tip of the pen (see FIG. 7). When the bosses 170 are received in the locking portions 160*d* of the grooves, the cap member overlies the major part of the tip end portion 112 and all of the flexible portion 116 of the barrel. In this retracted position (see FIG. 6), the writing tip of the pen is uncovered, an internal surface 146*a* on the tip end of the cap member is in close clearance with the proximal part 118*a* of the tapered surface 118 of the tip end portion of the barrel and an internal surface 146*b* of the cap is likewise in close clearance with a surface 112*a* on the barrel. The head end portion 146*c* of the cap member telescopically receives a reduced diameter portion 152 on the head end portion 114 of the barrel. In the retracted position, therefore, the cap surfaces 150*a*, 150*b* and 150*c* support the tip end portion 112 and flexible portion 116 of the barrel 110, relative to the head end portion 114** and make the pen substantially rigid. The user grips the pen in the usual manner with the thumb and fingers engaging the cap member. The locked position of the cap member sustains the writing pressure applied by the user.

To move the cap member between the extended and retracted positions, the user merely rotates the cap member in a direction to dislodge the bosses 170 on the cap member 146 from the locking portions **160*c* or 160*d*. The locking portions of the grooves are in interference fit with the bosses 170 so that a small amount of rotational force is required to move the bosses out of the locking portions. The remaining parts of the grooves are in clearance fit with the bosses, so that the cap member can easily first rotate and simultaneously move a short distance longitudinally as the bosses move through the oblique portions 160***b* of each groove and then slide longitudinally as the bosses move along the portions 160*a*. When the bosses 170 reach the oblique portions at the other end of the grooves, further longitudinal movement of the cap member also induces rotation of the cap member relative to the barrel, which signals to the user the direction of rotation required to lock the cap member in the new position. A user can quickly learn how to manipulate the cap and will thereafter use the pen properly as a matter of habit. The change from one locked position to the other can easily be made with one hand.

Relatively little force is required to maintain the locked position against rotation, but the bosses and grooves can be designed to provide a comparatively high force resisting longitudinal movement from the respective locked positions of the cap member. In the extended position (FIG. 7), the pen can bend along the flexible portion 116 in the manner described above and shown in FIG. 7; indeed the pen can be bent double so that the cap 146 touches the head end 114 of the barrel.

The above-described embodiment of the invention is intended to be merely exemplary, and numerous variations and modifications will be apparent to those of ordinary skill in the art. For example, the means by which the cap member is retained in the extended and retracted positions can be modified, such as by having bosses on the barrel and grooves on the inner surface of the cap. The length of the cap member can be such that it is only sufficiently longer than the flexible portion of the barrel to provide a substantially rigid coupling with the tip end portion and the head end portion so that the pen is substantially rigid when the cap member is in the retracted position for use. The writing tip is not necessarily limited to ball-point cartridges, although the type of writing tip used in the pen should be chosen with due attention to the shelf life for a particular type of packaging (hermetically sealed packages can make shelf life largely immaterial) and the useful life of the writing tip, inasmuch as the cap member of the pen does not fully enclose the writing tip. In the circumstances ball-point cartridges are preferred over the so-called felt-tip cartridges, which dry out when uncovered.

Thus, there is provided in accordance with the invention a pen that is inexpensive to manufacture and convenient to carry and use. The cap is securely retained on the barrel and is not removed when the pen is used, so it cannot be lost. The cap covers the tip when the pen is stored or transported, and the pen is flexible and, therefore, can be bent to fit more readily into pockets and small purses.

I claim:

1. A pen comprising an elongated one-piece barrel having substantially rigid tip end and head end portions joined to each other by an intermediate integral flexible portion, whereby the barrel can be bent at the flexible portion, a writing tip at the distal end of the tip end portion, a substantially rigid tubular cap member telescopically received over the tip end portion of the barrel and movable along the barrel between (1) a retracted position in which it overlies part of the tip end portion and substantially all of the flexible portion, and thus leaving the writing tip exposed and rendering the pen substantially rigid, and (2) an extended position in which it covers the writing tip and leaves the flexible portion exposed, thus protecting the writing tip and rendering the pen flexible, and means for releasably retaining the cap member in each of the retracted and extended positions, said means including at least one groove in either the outer surface of the tip end of the barrel or the inside surface of the cap member and a boss on the other end of the cap member and barrel received in the groove, the groove being coextensive with the distance between the extended and retracted positions of the cap member and including locking portions at each end offset circumferentially from adjacent end portions of the groove, whereby the cap member is locked in said respective portions in the absence of rotation relative to the barrel.

2. A pen according to claim 1 wherein the cap member has a length such that it covers a major part of the barrel when in the retracted position, the pen being thereby adapted to be held for use by gripping the cap member.

3. A pen according to claim 2 wherein an external circumferential surface of the tip end portion of the barrel closely adjacent the writing tip engages a matching internal surface of the cap member in the retracted position of the cap member, whereby the tip end portion is firmly supported within the cap member when the pen is in use.

4. A pen according in claim 1 wherein a major portion of the groove intermediate the locking portions extends substantially longitudinally of the pen, whereby the cap member is movable substantially longitudinally of the barrel over a major part of the distance between the extended and retracted positions.

5. A pen according to claim 4 wherein the end portions of the groove adjacent the locking portions are oriented obliquely to the longitudinal portion, whereby the direction of rotation of the cap member relative to the barrel into the corresponding locking portion is established before the respective extended and retracted positions are reached upon movement from one such position to the other.

6. A pen according to claim 1 wherein the end of the cap member that is nearer to the head end portion telescopically receives a part of the head end portion in the retracted position, thereby to restrict bending of the head end portion relative to the flexible portion.

7. A pen according to claim 1 wherein the flexible portion of the barrel comprises at least one bendable strip extending longitudinally between and joined to the tip end and head end portions and a multiplicity of longitudinally space-apart ribs extending transversely from the strip at least in each direction of bending of the strip, the adjacent pairs of ribs being engageable upon bending of the strip and limiting the amount of bending of each segment of the strip between adjacent ribs.

8. A pen according to claim 7 wherein there are two bendable strips located opposite each other adjacent the outer transverse extremity of the barrel and wherein the ribs are segments of rings that join the two strips transversely.

* * * * *